United States Patent [19]

Bylander

[11] 4,004,186

[45] Jan. 18, 1977

[54] VACUUM FLUORESCENT DISPLAY HAVING A GRID PLATE COPLANAR WITH THE ANODE

[75] Inventor: Ernest Gerald Bylander, Sherman, Tex.

[73] Assignee: Texas Instruments Incorporated, Dallas, Tex.

[22] Filed: Dec. 1, 1975

[21] Appl. No.: 636,471

[52] U.S. Cl. ..... 315/167; 313/494; 313/497; 313/513

[51] Int. Cl.$^2$ ..... H01J 1/72; H01J 63/06; H05B 37/02

[58] Field of Search ..... 313/496, 497, 494, 513; 315/167

[56] References Cited

UNITED STATES PATENTS

| | | | |
|---|---|---|---|
| 3,555,544 | 1/1971 | Atkins | 340/378 |
| 3,584,252 | 6/1971 | DuBois, Jr. | 313/496 |
| 3,668,466 | 6/1972 | Shimada | 313/497 X |
| 3,780,326 | 12/1973 | Raago | 313/496 |

*Primary Examiner*—Palmer C. Demeo
*Attorney, Agent, or Firm*—Harold Levine; Rene' E. Grossman; Richard P. Berg

[57] ABSTRACT

A vacuum fluorescent display is disclosed having a grid plate substantially coplanar with the anode and which is controllable with conventional metal oxide semiconductor devices. Each digit of the display includes a segmented anode structure substantially surrounded by a control electrode or grid plate. At least one cathode is disposed adjacent the anode segments and control electrode such that the distance between the cathode and the control electrode is less than the distance between the cathode and any of the anode segments. Utilizing such a structure, a voltage on the order of about −5 volts on the control electrode is effective to cut off luminescence from any of the anode segments of that digit.

7 Claims, 7 Drawing Figures

Fig. 4

VACUUM FLUORESCENT DISPLAY HAVING A GRID PLATE COPLANAR WITH THE ANODE

BACKGROUND OF THE INVENTION

This invention relates to vacuum fluorescent displays in general and more particularly, to a structure wherein a control electrode or grid is formed substantially coplanar with the anode and wherein the voltage required by the control electrode in order to completely cut off the tube from display is compatible with conventional MOS drive circuitry.

Vacuum fluorescent display tubes for displaying numerals or other characters have been widely used in computers, measuring apparatus, calculators and the like in order to provide a visual display of information. In conventional vacuum fluorescent displays, a cathode, grid and anode are formed within an evacuated envelope, at least one side of which is transparent. Typically a plurality of segmented anode patterns are formed on an insulating base which is mounted within the vacuum envelope. The anode segments are typically formed in the pattern of a figure "8" so that the numerals "0" through "9" may easily be displayed. Each of the anode segments is covered with a fluorescent material such as various phosphors. The cathode is positioned between the anode and the transparent side of the vacuum envelope. The cathode, however, does not interfere with visual observation of indicated characters and is generally formed of a very fine, almost invisible, wire capable of providing electronic emission when heated. Typically, a grid formed of a plurality of very fine wires is positioned between the cathode and anode. A separate grid is generally provided for each pattern of segmented anodes such that by applying a proper bias voltage to the grid it is possible to prevent any of the anode segments from luminescing even though a voltage may be applied between the anode and cathode. A typical vacuum fluorescent display is described in more detail in U.S. Pat. No. 3,508,101, patented Apr. 21, 1970.

A vacuum fluorescent display such as above described has enjoyed considerable success in the electronics industry. In an attempt to further reduce the costs associated with manufacturing such a display, however, it would be desirable to form the grid on the insulating base that supports the anode segments, rather than form the grid as a suspended electrode such as described in the aforementioned patent. If the control grid could be formed coplanar with the anode segments, less expensive manufacturing techniques could be utilized in fabricating the display. For example, the grid material could be screened onto the insulating base. Further, the display could be made more compact, and since the grid would not be positioned between the person viewing the display and anode segments, the display would be brighter.

One proposal for forming a grid coplanar with the anode segments is described in U.S. Pat. No. 3,668,466 granted June 6, 1972. Applicant has discovered, however, that while the technique described in this patent would provide a measure of improved manufacturing capability, the structure is not suitable for present day displays. For example, if the structure includes only one grid which surrounds the anode segments and is coplanar therewith, it is not possible to prevent anode segments directly underlying the cathode from luminescing unless a relatively large voltage, on the order of 50 volts, is applied to the grid. This is undesirable, since such a structure cannot be controlled using conventional metal oxide semiconductor circuitry; that is, conventional MOS circuitry such as used in calculators, central processing units, etc. have a reverse bias breakdown voltage on the order of 35–40 volts. If larger voltages than this are required, it is necessary to use bipolar interface circuitry between the display and MOS circuit or a special configuration of MOS transistors such as described in U.S. Pat. No. 3,818,245 in order to prevent reverse bias junction breakdown of the MOS transistors. The difficulties in using MOS circuitry to switch large voltages are described in more detail in the aforementioned U.S. Pat. No. 3,818,245.

SUMMARY OF THE INVENTION

Accordingly, it is an object of the present invention to provide a vacuum fluorescent display that is less costly and more easily manufactured than conventional fluorescent displays.

A further object of the invention is to provide an improved vacuum fluorescent display having a control electrode substantially coplanar with the anode and which can be driven using conventional MOS drive circuits.

An additional object of the present invention is to provide a vacuum fluorescent display having a control electrode substantially coplanar with the anode electrode, which control electrode is effective to prevent luminescence of any of the anode segments responsive to a bias on the order of about −5 volts.

Briefly and in accordance with the present invention, a vacuum fluorescent display includes a grid electrode that is formed substantially coplanar with the anode segments. The grid electrode laterally surrounds the anode segments which define each digit, and is insulated therefrom. At least one cathode is disposed with respect to the anode and grid electrode such that the distance separating the cathode from the grid electrode is less than the distance separating the cathode from any of the anode segments. Such a configuration enables the grid electrode to control luminescence of the anode segments responsive to a voltage that is compatible with conventional metal oxide semiconductor drive capabilities. In a preferred embodiment, a voltage on the order of a −5 volts applied to the grid electrode is effective to "cut off" luminescence from the anode segments associated therewith.

Other objects, advantages and features of the present invention will be apparent from the following detailed description of the invention taken in conjunction with the drawings, wherein:

DETAILED DESCRIPTION OF THE INVENTION

Figure 1:
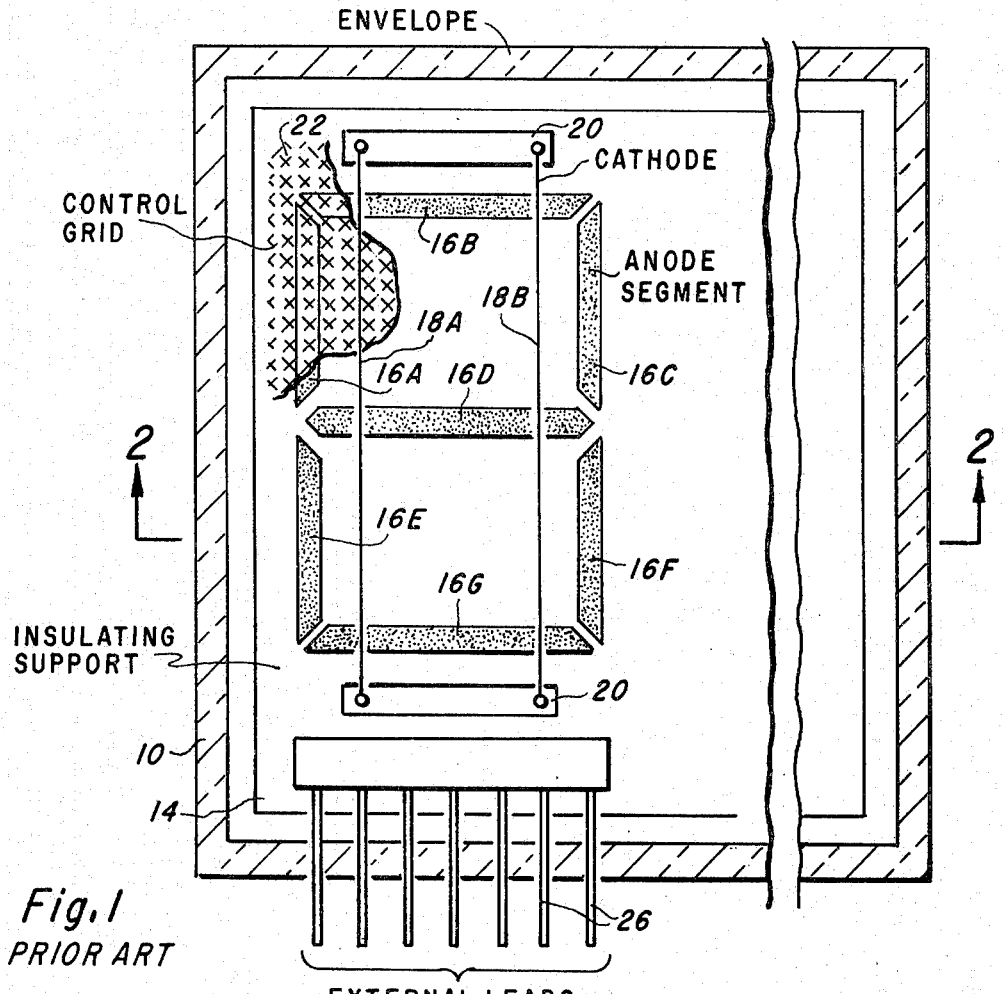
Fig. 1 PRIOR ART
FIG. 1 diagrammatically illustrates the components of a prior art triode configured vacuum fluorescent display.
Figure 2:
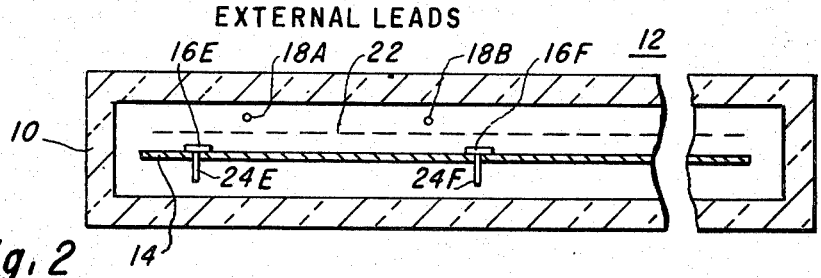
Fig. 2 PRIOR ART
FIG. 2 is a cross-sectional view of the prior art display of FIG. 1.

Referring now to FIGS. 1 and 2, there is illustrated a prior art configuration of a triode vacuum fluorescent display tube. An evacuated envelope is illustrated at 10. At least one side 12 of the envelope is transparent to light. Typically, the entire envelope is formed from glass. An insulating base 14 is mounted within the evacuated envelope by suitable means not shown. Anode segments 16A through 16G are formed on the surface of the insulating base 14 adjacent the transparent side 12 of the envelope 10. A 7 anode segment display is illustrated which can be utilized for displaying the numerals "0" through "9" by selectively activating the anode segments. Typically, a decimal point segment would also be included for each pattern of anode segments. Each of the anode segments 16A through 16G is covered with a layer of fluorescent material. Suitable fluorescent materials are well known in the art. Two cathodes 18A and 18B are suspended above the anode segments 16A through 16G by a suitable support 20. These cathodes are typically very fine wires which, when heated, will emit electrons toward the anode segments for causing luminescence thereof. A control grid 22 is suspended between the cathodes 18A and 18B and the anode segments 16A through 16G by suitable means not illustrated. The control grid typically includes a fine mesh of wire as well understood by those skilled in the art. The control grid 22, when suitably biased, is effective to prevent electrons emitted from cathodes 18A and 18B from reading the anode segments thereby preventing luminescence thereof. A separate control grid 22 is formed for each pattern of anode segments 16A through 16G of the vacuum fluorescent display. Typically, a plurality of digits would be included within each evacuated envelope 10, each digit including anode segments 16A through 16G and associated grid and cathodes. The anode segments 16A through 16G are each contacted by a lead 24 which extends through the insulating support 14 and makes contact with the anode segment. The anode segment leads, grid leads, and cathode leads extend through the envelope 10 to form external leads 26 to the vacuum fluorescent display tube.

Figure 3A:
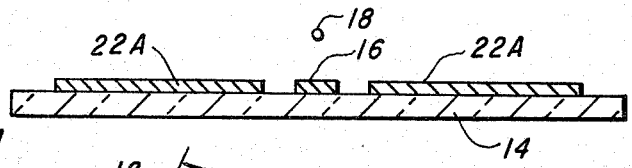
Fig. 3a PRIOR ART
FIG. 3*a* diagrammatically illustrates the location of the cathode, grid, and anode segments of a prior art vacuum fluorescent display having a grid substantially coplanar with the anode segments.

The triode structure illustrated in FIGS. 1 and 2 utilizes a grid that is suspended between the cathodes and anodes. From a manufacturing and cost viewpoint, it would be desirable to fabricate a vacuum fluorescent display wherein the grid is formed in the same plane as the anodes. Such a structure would also be more compact and would enhance viewing, since the grid would not be disposed between the luminescent anode segments and the viewer. A structure having a control grid disposed substantially coplanar with the anode segments is described in U.S. Pat. No. 3,668,466. FIG. 3*a* diagrammatically illustrates the arrangement of the cathode 18, anode 16 and control grid 22A in this patent. As can be seen, the control grid 22A is formed substantially coplanar with the anode 16. Further, it will be apparent that the cathode 18 is directly disposed over at least a part of the anode 16. In a typical configuration, the cathode 18 would be disposed above the anode 16 by a distance of 0.1 inches, and the anode 16 would be laterally spaced from the grid segments 22A by a distance of 0.03 inches. In this type of configuration with an anode-to-cathode voltage of 30 volts, the anode segments directly underlying the cathode 18 cannot be cut off by a grid voltage. As described in the U.S. Pat. No. 3,668,466, it is possible to put an auxiliary grid on the back side of the insulating substrate 14. In this situation, it is possible to completely cut off luminescence of any of the anode segments. To do so, however, a grid voltage of about −30 volts is required, making the total voltage across the tube on the order of 60 volts, a level that is not compatible with conventional MOS drive capabilities.

Figure 3B:
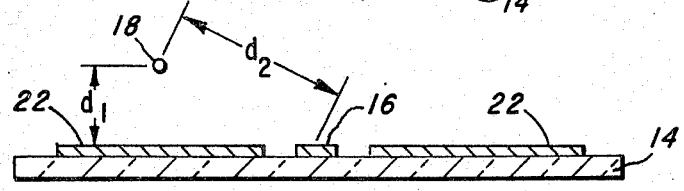
FIG. 3*b* diagrammatically illustrates an embodiment of the present invention, wherein the cathode is positioned so that it is closer to the grid than it is to any of the anode segments.

Applicant has discovered a configuration of a vacuum fluorescent display tube having a grid 22 coplanar with the anode segments 16 wherein a voltage on the order of −5 volts applied to the grid 22 is effective to completely cut off luminescence from all of the anode segments. This configuration is diagrammatically illustrated in FIG. 3*b* wherein the cathode 18 is disposed in such a configuration that the distance $d_1$ between the cathode and the grid is less than the distance $d_2$ between the cathode 18 and any of the anode segments 16. Using such a configuration, it is possible to use conventional MOS circuitry to drive the vacuum fluorescent display.

Figure 4:
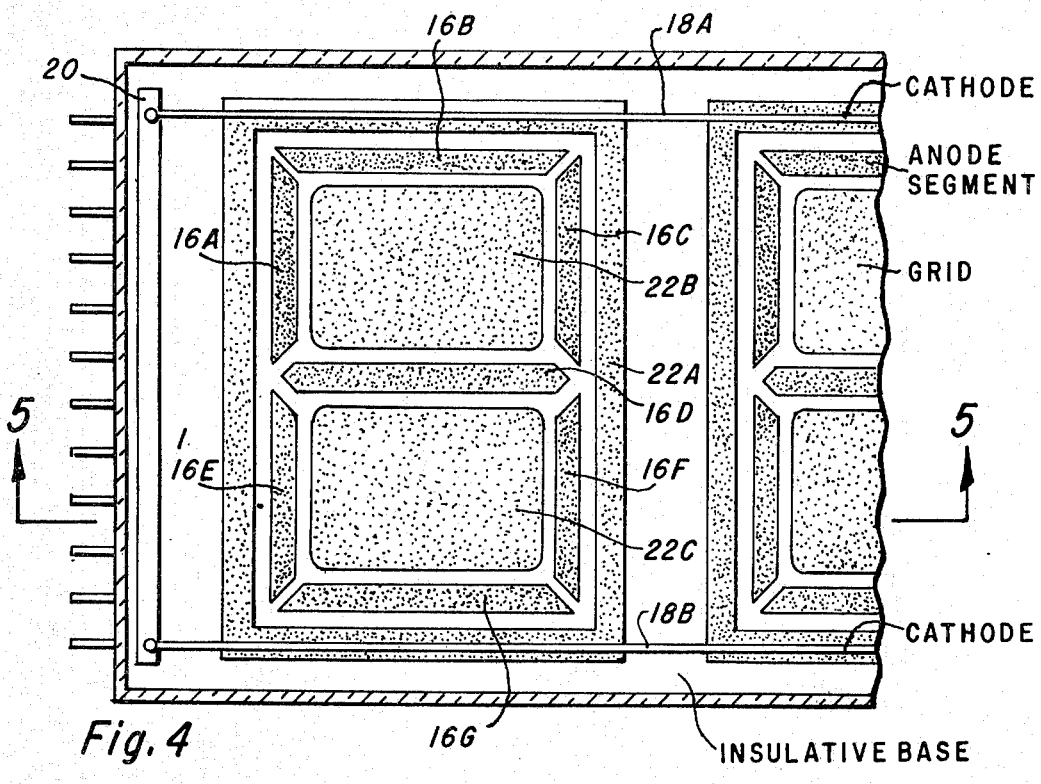
FIG. 4 diagrammatically illustrates in plan view a vacuum fluorescent display in accordance with the present invention having a grid substantially coplanar with the anode segments wherein the luminescence of a digit can be controlled by a voltage on the grid that is compatible with conventional MOS drive capabilities.
Figure 5:
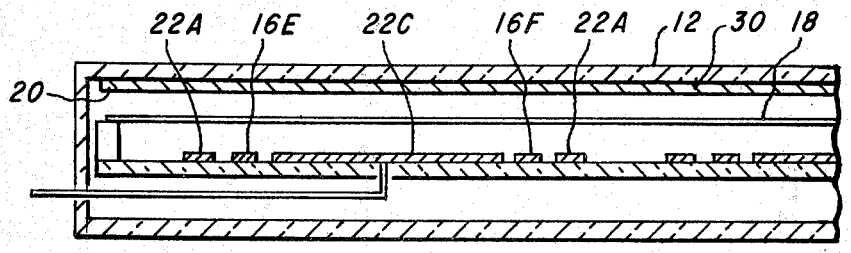
FIG. 5 is a cross-sectional view of the display illustrated in FIG. 4.

A preferred embodiment of the present invention is illustrated in FIGS. 4 and 5. In FIG. 4, there is illustrated a seven segment anode structure for each digit of the display. The anode segments 16A through 16G are each substantially surrounded by portions of the grid 22. The grid 22 is formed substantially coplanar with the anode segments 16 and are insulated therefrom. Each portion of the grid 22 for each digit of the display is electrically connected together; that is, portions 22A, 22B, and 22C are electrically connected in common. Cathodes 18A and 18B are suspended above the coplanar structure of the anodes 16 and grid 22 and further, are laterally spaced away from the pattern of anode segments such that neither of the cathodes 18A nor 18B directly overlie any of the anode segments 16A through 16G. The cathodes 18A and 18B are suspended by suitable means 20 which are well known in the art.

As best illustrated in FIG. 5, it may be advantageous to include a transparent layer 30 of conductive material such as tin oxide on the transparent face 12 of the envelope adjacent the cathodes 18A and 18B. By connecting the conductive layer 30 to a positive bias potential, the density of electrons emitted from cathodes 18A and 18B and striking the segmented anodes 16A through 16G can be made substantially uniform across the segmented anode pattern. Thus, the conductive layer 30 can advantageously be utilized to ensure a display of uniform intensity.

Figure 6:
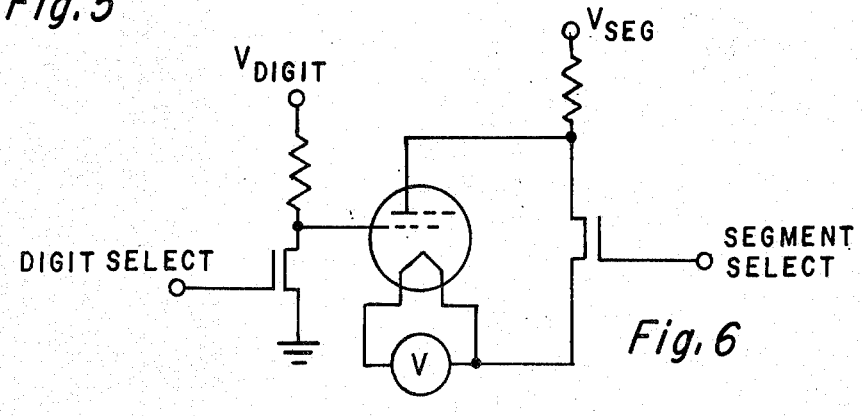
FIG. 6 schematically illustrates a vacuum fluorescent display system in accordance with the present invention, wherein conventional MOS circuitry can be utilized to drive a grid that is formed substantially coplanar with anode segments.

FIG. 6 is a simplified schematic diagram of a vacuum fluorescent display tube in accordance with the present invention. As can be seen from FIG. 6, conventional MOS circuitry can be utilized in order to drive the vacuum fluorescent display tube. This is made possible since the construction of the present invention permits utilization of a voltage on the order of −5 volts to control a grid that is formed substantially coplanar with the anode segments in order to prevent luminescence of any of the anode segments of a digit.

A preferred embodiment of the invention has been described. It will be understood, however, by those skilled in the art that various modifications may be made without departing from the spirit or scope of the present invention. For example, the invention has been described with respect to cathodes which are laterally spaced away from the anode segments and which extend longitudinally along the tube. It will be appreciated, of course, that cathodes could be disposed vertically along the sides of each digit or character of the display tube. Further, the invention is not limited to the described two cathode embodiment, but includes structures having any number of cathodes.

The invention has been described wherein the anode segments 16A through 16G are covered with fluorescent material. It will be understood, however, that it may be advantageous, particularly from a manufacturing point of view, to also coat at least a part of the grid 22 with fluorescent material. This can be effective to enhance luminescence characteristics of the display by providing improved contrast.

What is claimed is:

1. A character indicating tube comprising an evacuated envelope having at least one transparent side portion; an insulating base mounted within said envelope; at least one pattern of anode segments mounted on said insulating base for displaying a character, each of said anode segments having a phosphor coating thereon, said phosphor coating facing said transparent side portion; a control electrode insulated from and substantially laterally surrounding said anode segments, said control electrode being substantially coplanar with said anode segments; at least one cathode mounted in said envelope in the space between said transparent side portion and said insulating base, said at least one cathode being disposed such that the distance separating said at least one cathode and said control electrode is less than the distance separating said at least one cathode and any of said anode segments.

2. A character indicating tube as set forth in claim 1 further including an electrically conductive transparent auxiliary control electrode formed on said transparent side portion of said envelope, said auxiliary control electrode including means for connection to a bias potential.

3. A character indicating tube as set forth in claim 1 wherein each pattern of anode segments is formed in a substantially figure "8" configuration and wherein first and second cathodes are disposed in parallel relationship within said envelope, each of said first and second cathodes, laterally spaced away from the side portions of said figure "8" configuration such that the distance between each of said cathodes and said control electrode is less than the distance between said cathodes and any of said anode segments.

4. A character indicating tube as set forth in claim 1 wherein said at least one cathode is disposed above said at least one pattern of anode segments in such a manner so that it does not directly overlie any of said anode segments.

5. A display system comprising:

A. a character indicating tube including
   1. an evacuated envelope having at least one transparent side;
   2. an insulating base formed within said envelope and having a flat surface facing said transparent side of said envelope;
   3. a plurality of anode segment patterns formed on said flat surface, each pattern effective to define at least one character, each of said anode segments having a coating of phosphor material thereon;
   4. a plurality of control electrodes formed on said insulating base substantially coplanar with said anode segment patterns, each control electrode substantially surrounding a pattern of anode segments and electrically insulated therefrom;
   5. at least one cathode disposed in said tube such that the distance separating said cathode from said control electrode is less than the distance separating said cathode from any of said anode segments; and B. MOS circuit means directly connected to said anode segments and control electrodes for selectively applying voltages to said anode segment patterns and to said control electrodes in order to provide a display of desired characters, whereby a voltage on the order of about −5 volts, applied to the control electrode associated with one of said anode segment patterns is effective to prevent luminescence from that pattern.

6. A display system as set forth in claim 5 including a transparent conductive layer on said transparent side of said envelope, and means for connecting said conductive layer to a positive bias potential to thereby increase uniformity in the density of electrons emitted from said cathode and striking said plurality of anode segment patterns.

7. A display as set forth in claim 6 wherein phosphor material is deposited on at least a portion of said control electrodes.

* * * * *